US011136049B2

(12) United States Patent
Zarl et al.

(10) Patent No.: US 11,136,049 B2
(45) Date of Patent: Oct. 5, 2021

(54) DEVICE FOR SEALING AT LEAST ONE DOOR LEAF FOR A RAIL VEHICLE, AND RAIL VEHICLE

(71) Applicant: KNORR-BREMSE GESELLSCHAFT MIT BESCHRÄNKTER HAFTUNG, Mödling (AT)

(72) Inventors: Heinz Zarl, Zeillern (AT); Peter Jetzinger, Enns (AT)

(73) Assignee: KNORR-BREMSE GESELLSCHAFT MIT BESCHRÄNKTER HAFTUNG

( * ) Notice: Subject to any disclaimer, the term of this patent is extended or adjusted under 35 U.S.C. 154(b) by 203 days.

(21) Appl. No.: 16/329,977

(22) PCT Filed: Aug. 31, 2017

(86) PCT No.: PCT/EP2017/071881

§ 371 (c)(1),
(2) Date: Mar. 1, 2019

(87) PCT Pub. No.: WO2018/041954

PCT Pub. Date: Mar. 8, 2018

(65) Prior Publication Data

US 2019/0193758 A1 Jun. 27, 2019

(30) Foreign Application Priority Data

Sep. 1, 2016 (DE) ..... 10 2016 116 317.1

(51) Int. Cl.
*B61D 19/00* (2006.01)
*E05D 15/06* (2006.01)
(Continued)

(52) U.S. Cl.
CPC ..... *B61D 19/005* (2013.01); *B61D 19/008* (2013.01); *B61D 19/02* (2013.01);
(Continued)

(58) Field of Classification Search
CPC ..... B61D 19/005; E05D 15/0652; E05D 15/0608; E05D 15/1021; E05D 15/1023
See application file for complete search history.

(56) References Cited

U.S. PATENT DOCUMENTS 2,774,998 A * 12/1956 Kiekert ..... B61D 19/008 49/217
4,457,108 A * 7/1984 Kuschel ..... B60J 5/062 49/118
(Continued)

FOREIGN PATENT DOCUMENTS

AT 2427388 B 10/1965
DE 591933 C * 1/1934 ..... E05D 15/0608
(Continued)

OTHER PUBLICATIONS

International Search Report and Written Opinion for International Patent Application No. PCT/EP2017/071881; dated Dec. 15, 2017.

*Primary Examiner* — Marcus Menezes
(74) *Attorney, Agent, or Firm* — Barnes & Thornburg LLP

(57) ABSTRACT

The invention relates to a device for sealing at least one door leaf for a rail vehicle said device having at least one sliding element which is designed to move the door leaf in a z direction of the rail vehicle when it is close to a closed position in order to force a sealing element of the door leaf against a sealing counter-element of a portal of the rail vehicle.

11 Claims, 8 Drawing Sheets

(51) Int. Cl.
*E05D 15/10* (2006.01)
*B61D 19/02* (2006.01)

(52) U.S. Cl.
CPC ..... *E05D 15/0608* (2013.01); *E05D 15/0652* (2013.01); *E05D 15/1021* (2013.01); *E05D 15/1023* (2013.01); *E05D 15/1068* (2013.01); *E05D 2015/1084* (2013.01); *E05Y 2900/51* (2013.01)

(56) References Cited

U.S. PATENT DOCUMENTS 5,165,142 A * 11/1992 Pilsbury ..... B66B 13/301 16/90
5,301,468 A * 4/1994 Kamezaki ..... E05D 15/1021 49/225
5,305,855 A * 4/1994 Rivera ..... B66B 13/301 187/334
5,461,829 A * 10/1995 Lehto ..... E05D 15/1021 16/87 R
5,566,505 A * 10/1996 Kamezaki ..... E05D 15/1021 49/225
5,899,303 A * 5/1999 Allen ..... B66B 13/30 187/333
6,330,763 B1 * 12/2001 Kern ..... E06B 3/4636 49/226
7,367,159 B2 * 5/2008 Delgado ..... E05D 15/0652 49/116
7,610,718 B2 * 11/2009 Kopish ..... E05F 5/003 49/211
9,290,977 B2 * 3/2016 Haab ..... E05D 15/0652
2009/0183434 A1 * 7/2009 Puotunen ..... B60J 1/14 49/209
2011/0010998 A1 * 1/2011 Elliott ..... E05D 15/101 49/260
2018/0148966 A1 * 5/2018 Sakabe ..... E06B 3/4645

FOREIGN PATENT DOCUMENTS

DE 827504 C 1/1952
DE 1238502 B * 4/1967 ..... E05D 15/1044
DE 2244900 A1 * 3/1973 ..... E05D 15/063
DE 10116580 B4 4/2005
DE 202008004518 U1 8/2009
DE 202011110233 U1 3/2013
DE 102018101247 A1 * 7/2019 ..... E06B 7/231
EP 1584535 A1 10/2005
EP 2899091 A1 7/2015
FR 1029605 A * 6/1953 ..... B61D 19/008
SU 835865 A1 6/1981
WO 2015039160 A1 3/2015

* cited by examiner

DEVICE FOR SEALING AT LEAST ONE DOOR LEAF FOR A RAIL VEHICLE, AND RAIL VEHICLE

CROSS REFERENCE AND PRIORITY CLAIM

This patent application is a U.S. National Phase of International Patent Application No. PCT/EP2017/071881, filed Aug. 31, 2017, which claims priority to German Patent Application No. 10 2016 116 317.1, filed Sep. 1, 2016, the disclosure of which being incorporated herein by reference in their entireties.

FIELD

The disclosed embodiments relates to a device for sealing at least one door leaf for a rail vehicle, to a rail vehicle and to a method for sealing a sliding door.

BACKGROUND

In rail vehicles, sliding doors are often used. Sliding doors run, owing to the design, in an opening direction or closing direction along at least one guide rail. Grinding seals can be used to form a seal along this guide rail.

SUMMARY

The disclosed embodiments is based on the object of making available an improved device for sealing at least one door leaf for a rail vehicle, an improved rail vehicle and an improved method for sealing a sliding door.

According to the disclosed embodiments, this object is achieved by a device for sealing at least one door leaf for a rail vehicle, a rail vehicle and a method for sealing a sliding door.

BRIEF DESCRIPTION OF THE FIGURES

Exemplary embodiments of the approach presented here are illustrated in the drawings and explained in more detail in the following description. In the drawings.

Figure 1:
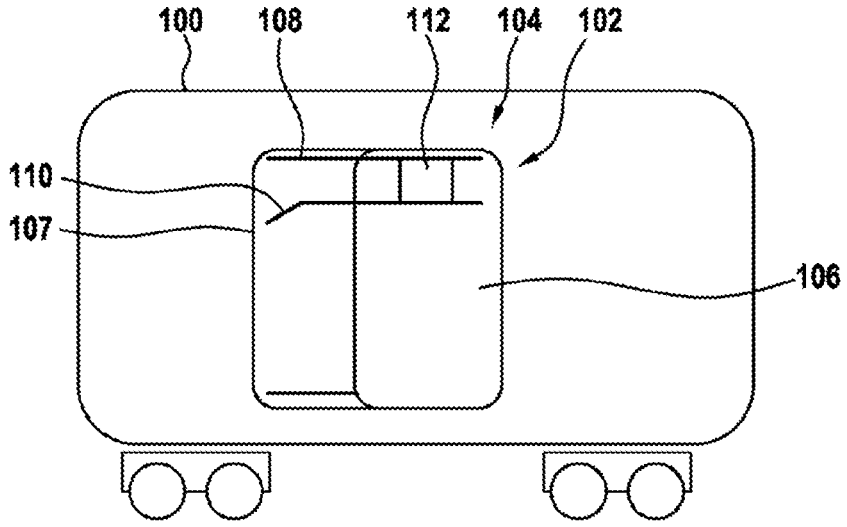
FIG. 1 shows an illustration of a rail vehicle with a sliding door according to an exemplary embodiment.

In the following description of advantageous exemplary embodiments of the present disclosed embodiments, identical or similar reference symbols are used for the elements which are illustrated in the various figures and act in similar ways, wherein a repeated description of these elements is dispensed with.

DETAILED DESCRIPTION

A device for sealing at least one door leaf for a rail vehicle is presented, wherein the device has at least one sliding element which is designed to move the door leaf in a z direction of the rail vehicle in the region of a closed position, in order to press a sealing element of the door leaf against a counter-sealing element of a portal of the rail vehicle.

Grinding of seals in a sliding door or pivoting sliding door can be largely prevented if a door leaf of the sliding door does not have any contact with the seals during the closing process and is in contact with the seals only as close as possible to a closed position. This can be achieved by a vertical movement of the door leaf. The door leaf can be moved using a guide system in a closing direction. In order in addition to achieve improved thermal insulation and additionally or alternatively to achieve improved sound insulation, it is possible to use a lifting device, also referred to as an elevating device, by which the door leaf can additionally be moved in the vertical direction, with the result that the vertical movement can be carried out. The lifting device can be embodied as a component of the guide system or as an independent device, and according to one embodiment can also be embodied as a retrofittable device. Therefore, the device for sealing can be understood, according to different embodiments, to be an independent lifting device as well as a component of the guide system or the entire guide system.

The door leaf can be, for example, a door leaf of a sliding door or of a pivoting sliding door. According to one embodiment, modularity is provided. For example, according to one embodiment, the guide system for the door leaf can be equipped with the lifting device without changes or without significant changes. Therefore, the lifting device can also be embodied as a subsequently retrofittable unit. A customer can therefore advantageously choose whether he wants to have a guide system "only" for opening and closing a door or else one with an improved sound seal or thermal seal by including the lifting device. This option can advantageously also be subsequently retrofitted. Therefore, the device for sealing can comprise at least one retrofittable component which can be installed in an existing door system, in order to make the door system movable in the vertical direction, and as a result permit improved sound protection and/or thermal protection.

The sliding element can be embodied as an active component which is designed to move the door leaf in response to a movement signal. The sliding element can also be designed to move the door leaf in an x direction of the rail vehicle, in order to move the door leaf between the closed position and an open position. Therefore, the device for sealing can comprise further functions of the guide system or can itself constitute the guide system. The sliding element can be embodied as a passive component which is designed to carry out a movement of the door leaf in the z direction using a movement of the door leaf in the x direction.

The sliding element can have at least one pivoting lever which can rotate about a pivoting point and has a guide arm. The pivoting point can be coupled to a supporting roller unit which is linearly movable along a supporting rail which is linear at least in certain sections. The guide arm is supported or capable of being supported on the guide path, for example, via a guiding roller unit which is movable along a guide path. In this context, the pivoting lever can have an attachment point for the door leaf.

According to one embodiment, the pivoting lever can have a first guide arm and a second guide arm. In this context, the first guide arm can have a first attachment point on which a first supporting roller unit for guiding a first guide arm along a guide path is arranged. The second guide arm can have a second attachment point, on which a second supporting roller unit for guiding the second guide arm along the guide path is arranged. The pivoting point can be coupled to the door leaf and can be arranged between the first attachment point and the second attachment point. Points, such as the pivoting point or the attachment points, can for example also be understood to be a position or location on the pivoting lever or, for example, also a passage opening for receiving an axle or shaft, or the center point of such a passage opening. The arrangement of the pivoting point between the attachment points can mean that the pivoting point can be arranged in the x direction, that is to say in parallel with the longitudinal axis of the vehicle, between the attachment points, wherein there can be an offset in the z direction, that is to say in parallel with a vertical axis of the vehicle. The guide path can have a linear guide face and a connecting link. The connecting link can be bent with respect to the guide face. A connecting link can serve as a guide element, for example for the guide roller unit. The guide roller unit can be steered onto a trajectory outside a plane of the guide face by the connecting link.

The guide path can be formed by the supporting rail or a linear section of the supporting rail. The connecting link can be connected in a positionally fixed fashion to the supporting rail. For example, the connecting link can be screwed on. The screwing on permits the connecting link to be easily positioned and secured. For example, the connecting link can be a wedge which is fitted onto the supporting rail.

The guide path can be formed by the supporting rail. The guide face and/or the connecting link can be embodied as a cutout from the supporting rail. For example, the guide path and/or the connecting link can be milled into the supporting rail. The milling permits the pivoting arm to be positioned precisely.

A transition from the guide face to the connecting link can be arranged less than 200 mm, for example also less than 120 mm or less than 80 millimeters before a closed position of the door leaf. As a result of the short distance, a short grinding path between the seals can be achieved. The first supporting roller unit can have a first supporting roller with a guide groove for guiding the first supporting roller along the linear guide face. The second supporting roller unit can have at least one second supporting roller with a guide groove for guiding the second supporting roller unit along the linear guide face and a connecting link face for guiding the second supporting roller unit along the connecting link. The movement path can be embodied with one track or two tracks. In the case of a two-track embodiment, the connecting link can be arranged in parallel with a section of the linear guide face. If the first supporting roller does not have a connecting link face, the first supporting roller can be guided further next to the connecting link on the specified section of the linear guide face, while the second supporting roller is guided on the basis of its connecting link face on the connecting link.

The attachment point can have travel of less than 15 millimeters. A small amount of travel is sufficient to separate the seals.

A load arm of the pivoting lever between the pivoting point and the attachment point can be shorter than the guide arm. As a result of the central position of the attachment point, a force acting on the supporting roller unit and the guide roller unit can be reduced.

The pivoting point can be arranged between the attachment point and the guide arm. The supporting roller unit can be loaded in an opposite direction to the guide roller unit by the attachment point at the free end. Therefore, the guide arm at least partially encloses the rail.

The supporting rail can have a convex supporting profile. The supporting roller unit can have at least one supporting roller with a concave rolling profile. The supporting profile can be at least partially enclosed by the rolling profile. Profiled rollers and rails result in good lateral guidance for the door leaf. An additional lateral guidance mechanism can therefore be dispensed with.

The guide system can have a door leaf carrier which is rotatably mounted at the attachment point. The door leaf carrier can be connected to the pivoting lever via a clip. The door leaf can be adjusted in its position by a door leaf carrier.

The door leaf carrier can be rotatably mounted in a further pivoting lever. Oscillation of the door leaf can be prevented by two pivoting levers.

Furthermore, a rail vehicle having a device according to the approach presented here is presented, wherein the supporting rail is oriented in the x direction, and the door leaf of a sliding door of the rail vehicle is connected to the attachment point of the pivoting lever, wherein the device is designed to raise or lower the door leaf in the region of the closed position.

In addition, a method for sealing a door leaf for a rail vehicle is presented, wherein in an operation of movement the region of a closed position of the door leaf the door leaf is moved in a z direction of the rail vehicle using the sliding element, in order to press a sealing element of the door leaf against a counter-sealing element of a portal of the rail vehicle.

FIG. 1 shows an illustration of a rail vehicle 100 with a sliding door 102 according to an exemplary embodiment. The sliding door 102 has a device 104 according to the approach illustrated here. The sliding door 102 has here a single door leaf 106. The door leaf 106 is movable in a vertical direction of the vehicle, that is to say upward or downward, using the device 104 for sealing. The vertical direction of the vehicle can be referred to as the z direction.

The device 104 has at least one sliding element 112. The sliding element is designed to move the door leaf 106 in the z direction in the region of a first closed position of the sliding door 102. In this context, a sealing element of the door leaf 106 is pressed against a counter-sealing element of a portal 107 of the rail vehicle 100. The door leaf 106 can be raised or lowered to form a seal.

The sliding element 112 can be an active component, that is to say an actuator, such as, for example, a pneumatic cylinder or an electric motor. According to one exemplary embodiment, the sliding element 112 is then actuated directly, in order to move the door leaf 106 in the z direction.

The sliding element 112 can subsequently be installed in the sliding door 102. For example, the sliding door 102 can already have receptacles for the sliding element 112.

In one exemplary embodiment, the device 104 comprises a supporting rail 108 which is oriented in a longitudinal direction of the vehicle, and a guide path 110 which is oriented essentially in the longitudinal direction of the vehicle. The sliding element 112 is embodied as a pivoting lever 112 and is movably mounted on the supporting rail 108 and connected to the door leaf 106. The pivoting lever 112 is supported on the guide path 110 at least nearly to a closed position of the door leaf 106, in order to bring about the vertical movement of the door leaf 106 via the pivoting lever 112.

According to one exemplary embodiment, the supporting rail 108 is embodied in an overall linear fashion. Alternatively, the supporting rail 108 can be embodied in a linear fashion in certain sections. According to one exemplary embodiment, the supporting rail 108 is embodied in a linear fashion at least in one section which forms a guide path.

The device 104 can be referred to as a guide system 104 and is designed to lower the door leaf 106 during a closing movement of the sliding door 102 in the region of the closed position, in order to bring seal devices on an upper edge and a lower edge of the sliding door into contact. Conversely, the door leaf 106 can be raised in the region of the closed position during the opening process, in order to separate the seal devices.

According to the approach described here, sliding doors 102 can advantageously be sealed very well both in the upper and in the lower region. For this purpose, there is no need for a grinding seal which is difficult to adjust. The sealing of the sliding doors 102 is required in order to improve the comfort for the passengers with respect to the sound insulation and the pressure tightness or also the thermal insulation for low energy consumption.

In the approach presented here, the door leaf 106 is raised or lowered. The raising or lowering can be referred to as displacement in the z direction. This function is basically dependent on the drive system for driving the door leaf 106 in the x direction and for locking the door leaf 106. As a result of the raising or the lowering, a sealing face in the upper and/or lower region of the door leaf 106 is sealed in addition to the rear edge and front edge or the finger protection rubber. The seal at the top or the bottom is effected by virtue of the fact that a seal is pressed against a sealing face, or the distance between two sealing faces is reduced. For example, the sealing faces can rest one on the other, as a result of which the distance between the sealing faces is zero. Basically, the raising of the door leaf 106 is carried out as close as possible to the closed position of the door leaf 106.

In one exemplary embodiment, the z movement of the door leaf 106 is also carried out by active components such as servomotors, magnets or cylinders. In a further exemplary embodiment, the z movement of the door leaf 106 is achieved by the drive, already present for the sliding movement, in the x direction, and suitable kinematics. The raising or lowering or the z travel of the sliding door is optimally carried out only when the closed position is reached, as a result of which a pure z movement without additional x movement and y movement is achieved, in order to minimize as far as possible a grinding distance of the seal at the top and the bottom. The raising can be effected, for example, by a lever system 112. Correspondingly, the door leaf can be lowered, as illustrated here.

In one exemplary embodiment, the rail vehicle 100 has a pivoting sliding door 102 which is raised or lowered by the device 104 in the z direction in the region of the closed position, in order to seal the sealing elements.

Figure 2:
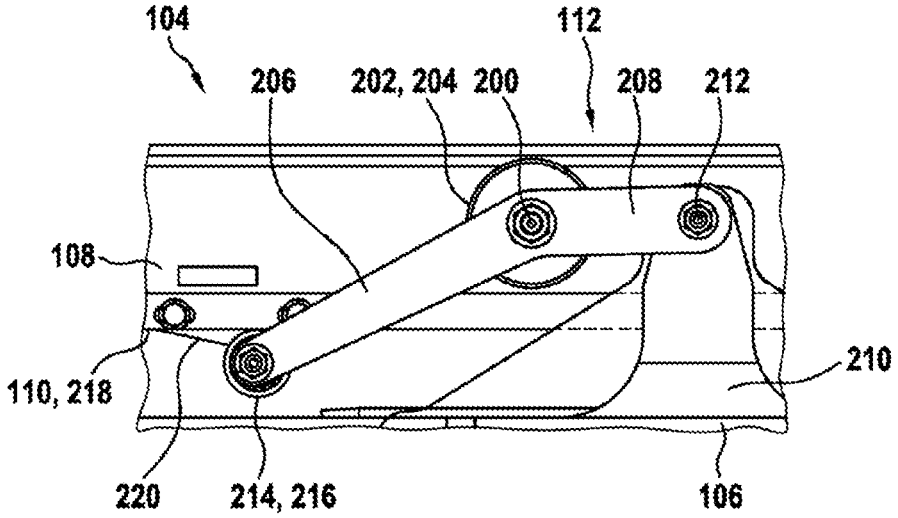
FIG. 2 shows an illustration of a device according to an exemplary embodiment.

FIG. 2 shows an illustration of a device 104 according to an exemplary embodiment. The device 104 corresponds essentially to the device in FIG. 1. In contrast to this, the device 104 is, however, designed here to move the door leaf 106 in the vertical direction of the vehicle in the region of the closed position during the closing process, or raise it according to this exemplary embodiment. A pivoting point 200 or a rotational axis 200 of the pivoting lever 112 is rotatably mounted in a supporting roller unit 202. The supporting roller unit 202 has here a single supporting roller 204 which rolls in the longitudinal direction of the vehicle on the supporting rail 108 during the opening movement and the closing movement. In this context, the rotational axis 200 corresponds to a rotational axis of the supporting roller 204. The supporting roller unit 202 can also have a plurality of supporting rollers 204, wherein the rotational axis 200 then runs, for example, through a center of gravity of the supporting roller unit 202. The longitudinal direction of the vehicle can then be referred to as an x direction. The pivoting lever 112 has a guide arm 206 and a load arm 208. The door leaf 106 is suspended from the load arm 208 via a clip 210. In other words, the load arm 208 has an attachment point 212 for the door leaf 106. At one end of the guide arm 206, a guide roller unit 214 is arranged. The guide arm 206 supports on the guide path 110, via the guide roller unit 214, a torque which results from the weight force of the door leaf 106. The guide roller unit 214 has here a single guide roller 216. The rotational axis of the guide roller 216 is essentially parallel to the rotational axis of the supporting roller 204. The guide roller unit 214 can also have a plurality of guide rollers 216.

The guide path 110 is formed here by a guide face 218 of the supporting rail 108 and a connecting unit 220 which is screwed onto the supporting rail 108. The connecting unit 220 forms a rolling face, oriented obliquely with respect to the guide face 218, for the guide roller 216. When the guide roller 216 rolls on the connecting unit 220, the pivoting lever 112 is rotated about its rotational axis 200, and the door leaf 106 is raised. In one exemplary embodiment, the guide path 110 is formed by the guide face 218 and a cutout from the supporting rail 108. The guide roller 216 then rolls from the guide face 218 into the cutout, and the pivoting lever 112 rotates in the opposite direction about the rotational axis 200, wherein the door leaf 106 is lowered.

The load arm 208 is oriented essentially horizontally here when the guide roller 216 bears on the guide face 218. The guide arm 206 is bent with respect to the load arm 208 and points obliquely downward. The load arm 208 is approximately half as long as the guide arm 206. As a result, a lever ratio is produced in which the guide roller 216 is pressed with approximately half the weight force of the door leaf 106, loading the load arm 208, against the guide path 110. In this context, approximately one and a half times the weight force loads the supporting roller 204.

In other words, FIG. 2 shows a device 104 for raising the sliding door 106. The device 104 is used, for example, in a sliding door entry system.

Figure 3:
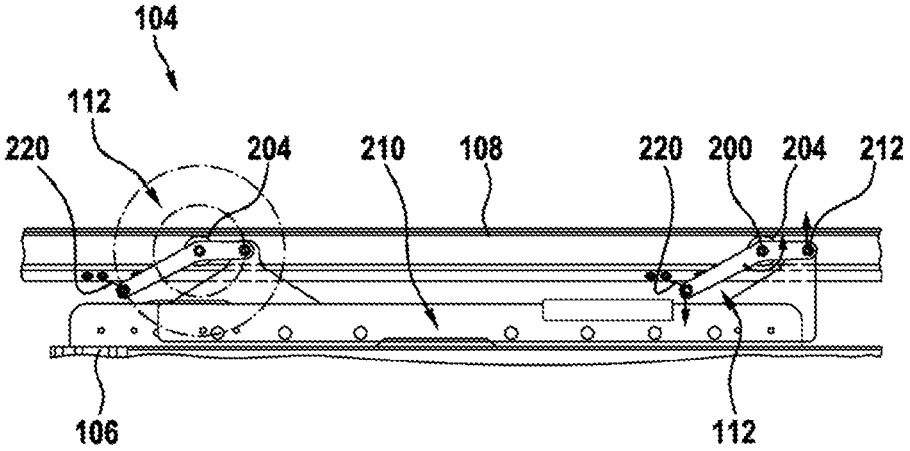
FIG. 3 shows an illustration of a device having a further pivoting lever according to an exemplary embodiment.

FIG. 3 shows an illustration of a device 104 with a further pivoting lever 112 according to an exemplary embodiment. The device 104 corresponds essentially to the device in FIG. 2. In addition to this, the device 104 has a further pivoting lever 112 which is identical in design to the pivoting lever 112 and rolls on the supporting rail 108 spaced apart from the pivoting lever 112 by a further supporting roller 204, approximately by one door width of the door leaf 106. In this process, the clip 210 extends essentially over the door width and is coupled to both pivoting levers 112. The door leaf 106 is screwed to the clip 210. The further pivoting lever 112 is pivoted in the region of the closed position by a further connecting link 220 which is arranged on the supporting rail 108.

In other words, FIG. 3 shows a mechanism 104 for raising. With this concept, lowering can basically also be implemented in the closed position.

Parameters can be considered for the optimization with respect to a smallest possible displacement force or drive force with the smallest possible sealing travel, that is to say the travel of the door leaf 106 in the z direction. In this context, at least a small degree of release is necessary in order to prevent grinding of the seal over the entire travel distance, for example travel of the door, that is to say the movement in the x direction. For example, the lever ratios owing to the coordinate positions of the pivoting point 200, of the attachment point 212 and of the guide point are taken into account. Likewise, the weight force of the door leaf 106 can be taken into account. Furthermore, the sealing forces (N/mm) at the top and the bottom and the sealing forces as a result of the seal on the rear edge and on the finger protection rubber can be taken into account. A parameter is also a maximum possible drive force and a maximum necessary travel in the z direction. Inclination of the connecting link 220 can also be taken into account. A further parameter is grinding travel of the transverse seals at the top and/or bottom. This should be minimal in order to minimize the sealing wear. Likewise, a desired travel distance in the x direction just before the closed position can be taken into account in the case of a connecting link inclination of zero degrees. This can ensure that in the closed and locked position of the entry system no force is generated in the opening direction, which would counteract the locking. If the roller in the connecting link 220 is at an angle greater than zero degrees, a force component in the x direction is automatically produced as a function of the weight force of the door leaf 106 and of the connecting link angle.

Raising of the door leaf 106 additionally provides the advantage that when there is any emergency activation of the system 104 the door leaf 106 is pressed in the opening direction via the connection link 220 by the weight force of the door leaf 106, and a certain gap can therefore be produced between the finger protection rubbers.

Figure 4:
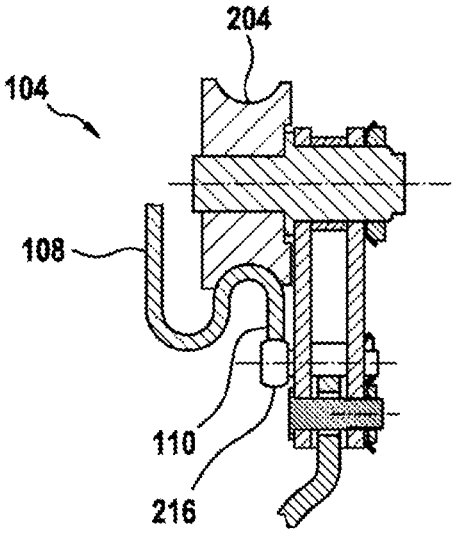
FIG. 4 shows a sectional illustration of a device according to an exemplary embodiment.

FIG. 4 shows a sectional illustration of a device 104 according to an exemplary embodiment. The device 104 corresponds essentially to one of the devices illustrated in FIGS. 1 to 3. The supporting rail 108 and the guide path 110 are embodied in one piece by a sheet-metal profile. The supporting rail 108 has here a convex supporting profile, while the supporting roller 204 has a concave rolling profile. As a result of the combination of the concave and convex profiles, the supporting roller 204 is guided in a lateral direction of the vehicle or a y direction. The guide roller 216 and the guide path 110 have a flat profile.

Figure 5:
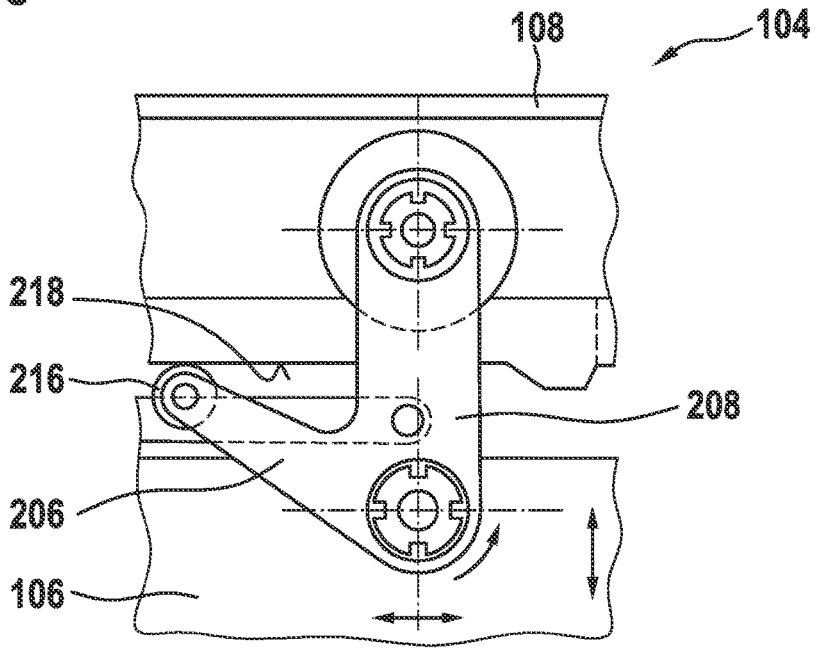
FIG. 5 shows an illustration of a device according to an exemplary embodiment.

FIG. 5 shows an illustration of a device 104 according to an exemplary embodiment. The device 104 corresponds essentially to the device in FIG. 4. Here, the load arm 208 is oriented in a line with the weight force. The load arm 208 therefore hangs vertically downward. The guide arm 206 is bent here and is integrated partially into the load arm 208. The lever arm of the guide arm 206 is approximately the same size as the load arm 208.

The guide face 218 is embodied here as a cutout from the supporting rail 108. The oblique rolling face is embodied as a runout of the cutout. If the guide roller 216 is arranged in the region of the guide face 218, it is essentially not loaded and can lose contact with the guide face. If the guide roller 216 is arranged in the region of the oblique rolling face, the load arm 208 is deflected laterally upward with the door leaf 106.

Figure 6:
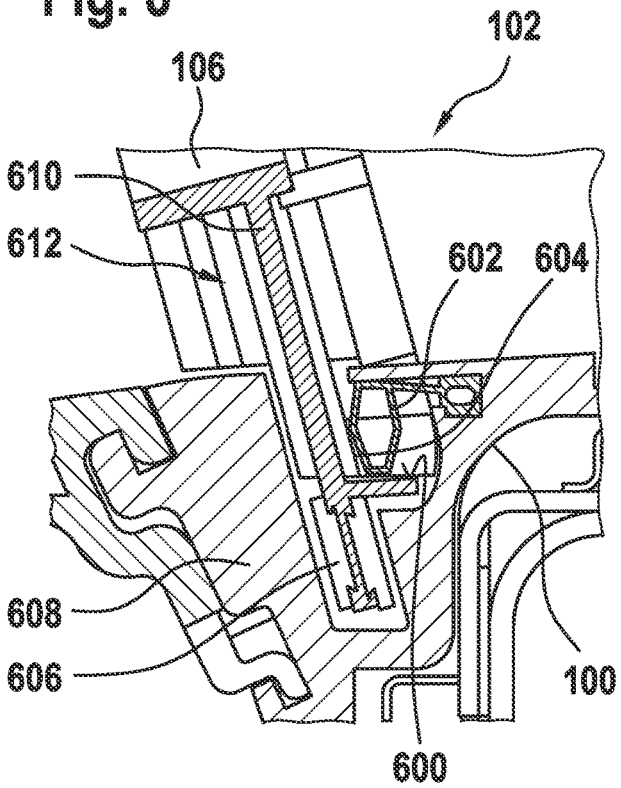
FIGS. 6 and 6A show an illustration of a lifting movement of a sliding door according to an exemplary embodiment.

FIG. 6 shows an illustration of a lifting movement of a sliding door 102 according to an exemplary embodiment. The sliding door 102 is guided according to the approach presented here, using a guide system. As a result of the guide system, the door leaf 106 of the sliding door 102 carries out an essentially vertical movement in the region of the closed position. As a result of the movement, a sealing face 600 is pressed against a sealing element 602, and a gap 604 between the door leaf 106 and a frame 606 of the sliding door 102 is sealed.

Here, the sealing face 600 is arranged so as to be movable with the door leaf 106, and the sealing element 602 is arranged on the frame 606.

The door leaf 106 is guided here in the y direction by a lower portion of the frame 606. The lower portion of the frame 606 is arranged in a pocket and is also movable in the z direction in the pocket. A tread bar profile 608 is arranged on an outer side of the sliding door 102. The door leaf 106 runs in a slit between the tread bar profile 608 and a floor of the rail vehicle 100.

The sealing face 600 is formed by a lower transverse profile 610 of the door leaf 106. A molded part 612 is arranged as a sealing profile on a rear edge of the door leaf.

Figure 6A:
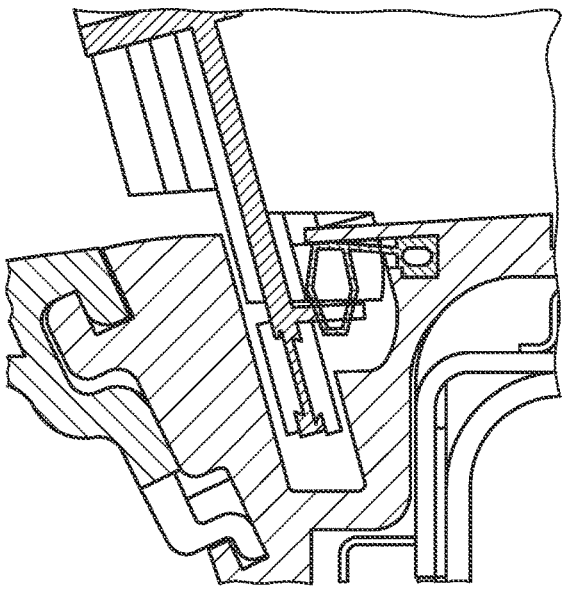

In other words, FIGS. 6 and 6A show an example of a seal of the door leaf 106 at the bottom. In this context, the door leaf 106 is illustrated raised once into the open position and once into the closed position for the concept of the door leaf 106. The seal 602 at the bottom is on the portal side, that is to say is not formed on the door leaf 106. Conversely, the seal 602 can also be arranged on the door leaf 106. The sealing face 600 is located on the door leaf 106. The lower guide is embodied in a conventional fashion here, wherein despite the travel in the z direction there is still sufficient coverage of the guide system present.

Figure 7:
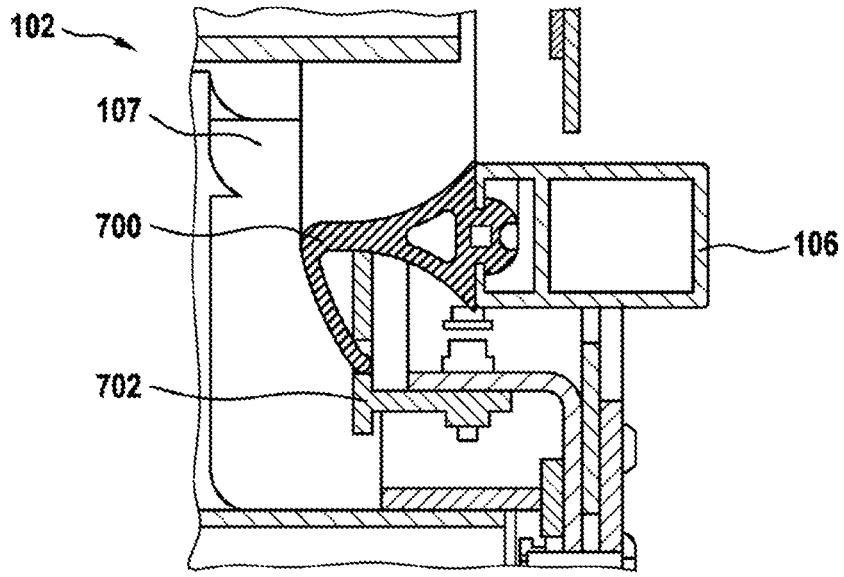
FIG. 7 shows an illustration of a sealing element for a sliding door according to an exemplary embodiment.

FIG. 7 shows an illustration of a sealing element 700 for a sliding door 102 according to an exemplary embodiment. The sealing element 700 is arranged on a rear edge of the door leaf 106 and is movable with the door leaf 106 in the x direction. The sealing element 700 forms a seal against a sealing face 702 which is arranged on a portal 107 of the sliding door 102. The sealing face 702 is formed by a sealing angle. The sealing element 700 is embodied as a deformable lip.

In other words, FIG. 7 shows an example of a seal of a door leaf rear edge. The seal 700 can again be provided on the portal side or the door leaf side. For the junctions with the transverse seals at the top and the bottom it is possible to use corresponding molded parts in order to make the leakage area minimal at the junction.

Figure 8:
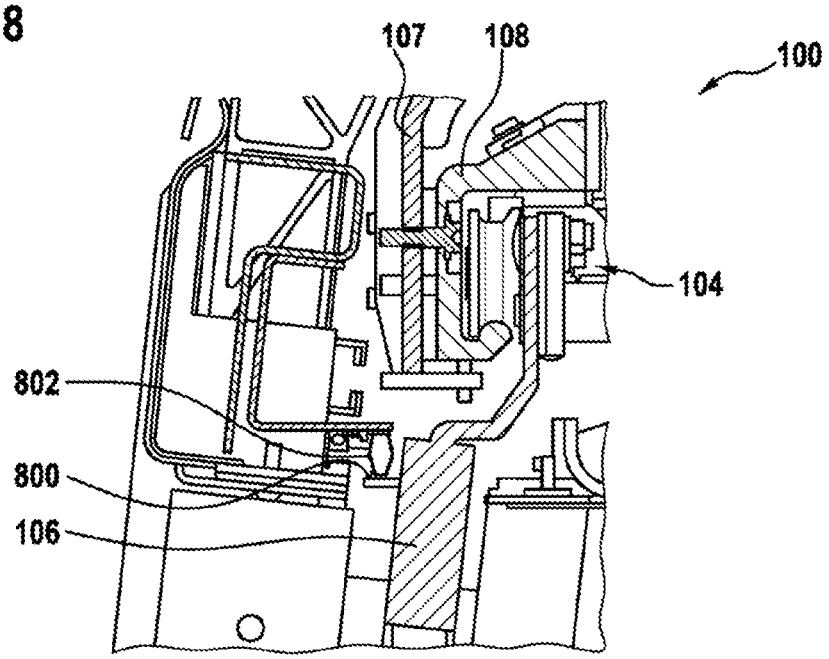
FIG. 8 shows an illustration of a detail of a rail vehicle having a device according to an exemplary embodiment.

FIG. 8 shows an illustration of a detail of a rail vehicle 100 with a device 104 according to an exemplary embodiment. The device 104 corresponds here essentially to one of the devices in FIGS. 1 to 5. The device 104 is integrated into a portal 107 of the rail vehicle 100. In this context, the supporting rail 108 is permanently connected to the portal 107. The pivoting lever 112 is guided on the supporting rail 108 and connected to the door leaf 106. An upper sealing face 800 is arranged on the door leaf 106, while an upper sealing element 802 is arranged on the portal 107. The sealing face 800 is pressed against the sealing element 802 by the vertical movement of the door leaf 106 in the region of the closed position, and it seals the gap between the door leaf 106 and the portal 107.

The upper sealing face 800 is here a component of an upper transverse profile of the door leaf 106.

In other words, FIG. 8 shows an example of a seal on the door leaf 106 at the top. In this context, the upper position is illustrated. The seal 802 is embodied on the portal side and the sealing face 800 is located on the door leaf 106.

The seal 802 itself can be provided as a complete, peripheral sealing frame on the portal 107 of the vehicle 100. As a result, a very good junction between the longitudinal seal and the transverse seal is provided, and at the junction of the door leaves. The door leaf 106 is the sealing face 800 and does not require a receptacle for seals, apart from the finger protection rubbers.

If such a solution is not possible, the seals 802 can also be provided on the door leaf 106, wherein the sealing faces 800 are then provided on the portal 107. As a result of the raising of the door seals 802, the seals or molded parts can be embodied at the junctions between longitudinal seals and transverse seals in such a way that there is no leakage area present in the closed position.

Figure 9:
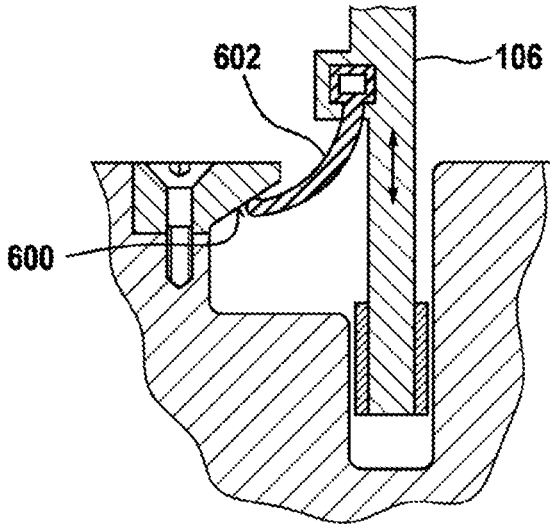
FIG. 9 shows an illustration of a sealing element for a sliding door according to an exemplary embodiment.

FIG. 9 shows an illustration of a sealing element 602 for a sliding door 102 according to an exemplary embodiment. The sealing element 602 can be used, for example, instead of the sealing element in FIG. 6. Here, the sealing element 602 is attached to the door leaf 106. The sealing face 600 is fixed to the vehicle. The sealing element 602 is embodied as a deformable lip as in FIG. 7. If the door leaf is raised by the guide system, the sealing element 602 is in contact with the sealing face 600 and seals the slit in the floor.

Figure 10:
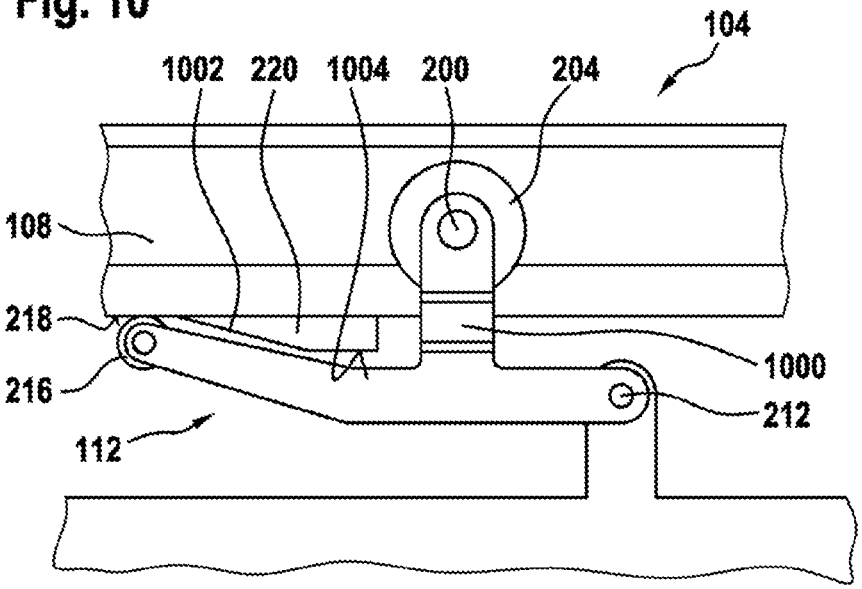
FIG. 10 shows an illustration of a device according to an exemplary embodiment.

FIG. 10 shows an illustration of a device 104 according to an exemplary embodiment. The device 104 corresponds essentially to the device in FIGS. 2 and 3. In contrast to this, the pivoting lever 112 has an upwardly oriented projection 1000 which has the pivoting point 200. The pivoting point 200 corresponds here to a pivoting point of the supporting roller 204. A center of gravity of the pivoting lever 112 is arranged underneath the pivoting point 200, as a result of which the pivoting lever 112 has a high degree of intrinsic stability. The attachment point 212 is arranged essentially at a height with the guide rail 216 here.

The connecting link 220 is connected in a positionally fixed fashion to the supporting rail 108. For example, the connecting link 220 is welded or bonded to the supporting rail 108. The connecting link 220 has the oblique face 1002 which is oriented obliquely with respect to the guide face 218, and a latching face 1004 which is oriented in parallel with the guide face 218. The guide roller 216 is arranged on the latching face 1004 in the closed position. From a start of the oblique face 1002 as far as the closed position the connecting link 220 has a length of less than 80 millimeters.

During a closing movement, the guide roller 216 rolls downward over the oblique face 1002. As a result, the attachment point 212 is raised on the opposite side of the pivoting point 200. The attachment point 212 is raised by less than 15 millimeters.

Figure 11:
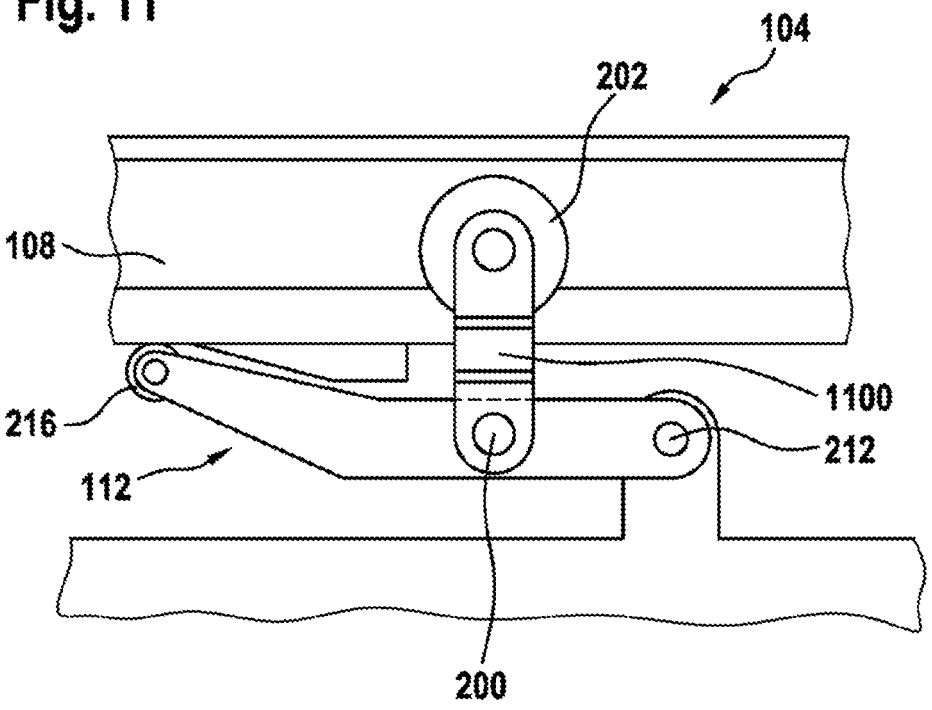
FIG. 11 shows an illustration of a coupled device according to an exemplary embodiment.

FIG. 11 shows an illustration of a coupled device 104 according to an exemplary embodiment. The device 104 corresponds here essentially to the device in FIG. 10. In contrast to this, the pivoting point 200 rests essentially on a connecting line between the attachment point 212 and the guide roller 216 here. The pivoting point 200 is rotatably mounted in a coupling element 1100. The coupling element 1100 couples the pivoting point 200 to the supporting roller unit 202. The trajectory of the attachment point 212 is oriented essentially transversely with respect to the supporting rail 108 by the coupling element 1100.

Figure 12:
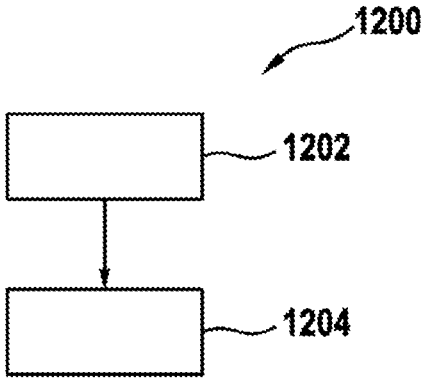
FIG. 12 shows a flow chart of a method for sealing according to an exemplary embodiment.

FIG. 12 shows a flow chart of a method 1200 for sealing a door leaf for a rail vehicle, wherein in an operation 1204 of the movement in the region of a closed position of the door leaf the door leaf is moved in a z direction of the rail vehicle using a displacement device, in order to press a sealing element of the door leaf against a counter-sealing element of a portal of the rail vehicle. According to one exemplary embodiment, the operation 1204 is embodied independently of a further closing movement of the door leaf.

According to a further exemplary embodiment, the operation 1204 is embodied together with or in combination with a further closing movement of the door leaf. For this purpose, the method 1200 also has, for example, a guidance operation 1202 in which the door leaf of the sliding door is guided, according to the approach presented here, from an open position in a closing direction as far as a region of a closed position using a guide system. Between the open position and the region of the closed position, at least one sealing face, oriented in the closing direction, of the sliding door and at least one sealing element, oriented in the closing direction, of the sliding door are guided in a contactless fashion using the guide system. In the raising or lowering operation 1204, the door leaf is raised or lowered in the region of the closed position using the guide system, in order to make contact with the sealing face and the sealing element.

Before or during the opening of the door leaf, the operation 1204 can be carried out again, wherein the door leaf is then moved in the opposite Z direction compared to the movement during the closing process, in order to release the sealing element of the door leaf from the counter-sealing element of the portal. Correspondingly, the operation 1202 can be carried out again during the opening process, wherein the door leaf is also subjected to an opposing movement in comparison to the movement during the closing process.

Figure 13:
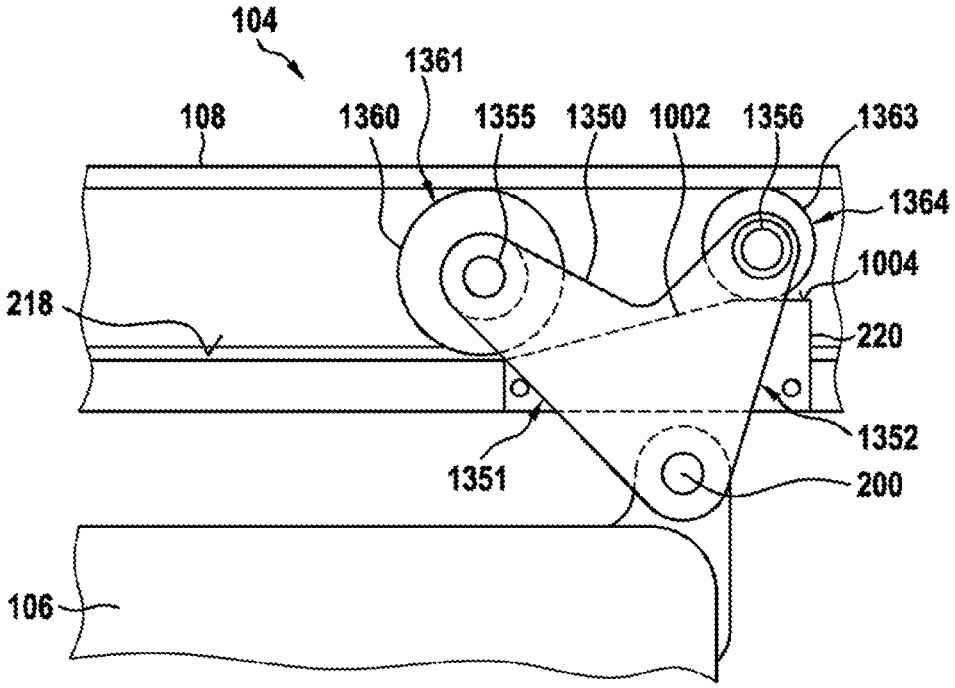
FIG. 13 shows an illustration of a device for sealing at least one door leaf according to an exemplary embodiment.

FIG. 13 shows an illustration of a device 104 for sealing at least one door leaf 106 for a vehicle according to an exemplary embodiment. This can involve, for example, a vehicle as described with reference to FIG. 1. The device 104 comprises a pivoting lever 1350 with a first guide arm 1351 and a second guide arm 1352. The pivoting lever 1350 is formed, for example, in a U shape or V shape. The guide arms 1351, 1352 form limbs of the pivoting lever 1350. In a connecting region of the guide arms 1351, 1352, the pivoting lever 1350 has a pivoting point 200, by which the pivoting lever 1350 can be connected, and is connected in the illustration shown in FIG. 13, in a pivotable fashion to a door leaf 106. According to this exemplary embodiment, the pivoting lever 1350 has a round passage opening in the region of the pivoting point 200. For example an axle or shaft which is coupled to the door leaf 106 can be guided through the passage opening.

The first guide arm 1351 has at its free end a first attachment point 1355, and the second guide arm 1352 has at its free end a second attachment point 1356. According to this exemplary embodiment, the guide arms 1351, 1352 each have, in the region of the attachment points 1355, 1356, a passage opening, for example for receiving a shaft or axle. According to the exemplary embodiment shown, a first supporting roller 1360 of a first supporting roller unit 1361 is attached to the first guide arm 1351 at the first attachment point 1355, and at least one second supporting roller 1363 of a second supporting roller unit 1364 is attached to the second guide arm 1352 at the second attachment point 1356. The supporting roller units 1361, 1364 can comprise not only the supporting rollers 1360, 1363 but, for example, also axles for attaching the supporting rollers 1360, 1363 to the attachment points 1355, 1356.

According to one exemplary embodiment, the pivoting lever 1350 is embodied as a planar plate which extends in the x-y plane. Alternatively, the pivoting lever 1350 can also have at least one bend. The attachment points 1355, 1356 are arranged opposite with respect to one another in the x direction. The pivoting point 200 is arranged between the attachment points 1355, 1356 with respect to the x direction. If the guide arms 1351 and 1352 run, in contrast to the exemplary embodiment shown in FIG. 13, in parallel with one another, the pivoting point 200 can be arranged on a connecting line connecting the attachment points 1355, 1356. If the guide arms 1351, 1352 are, as shown in FIG. 13, bent with respect to one another, the pivoting point can be arranged in the z direction, here, for example, in the direction of a lower edge of the door leaf 106, offset with respect to the attachment points 1355, 1356.

A supporting rail 108 with a guide face 218 and a connecting link 220 of the vehicle or of a door portal of the vehicle is shown in FIG. 13. The guide face 218 constitutes a path running in the x direction. The supporting rollers 1360, 1363 are shaped in order to be able to roll along the guide face 218. The connecting link 220 is embodied according to this exemplary embodiment as a plate-shaped element which is attached to the supporting rail 108. One edge of the connecting link 220 is formed as an oblique face 1002 which is oriented obliquely with respect to the guide face 218, and a latching face 1004 which adjoins the oblique face 1002 and is oriented parallel with respect to the guide face 218 is formed. The oblique face 1002 starts at the height of the guide face 218. According to this exemplary embodiment, the second supporting roller unit 1364 has a single second supporting roller 1363 which is shaped in such a way that it rolls no further on the guide face 218 at the height of the connecting link 220 but rather on the oblique face 1002 and the latching face 1004. The guide face 218 therefore forms, together with the oblique face 1002 and the latching face 1004, a guide path for guiding the supporting rollers 1360, 1363 during a closing movement and an opening movement of the door leaf 106. In this context, according to one exemplary embodiment the first supporting roller 1360 runs exclusively on a section of the guide path formed by the guide face 218.

According to one exemplary embodiment, a distance in the x direction between the first attachment point 1355 and the pivoting point 200 has the value a and a distance in the x direction between the second attachment point 1356 and the pivoting point 200 has the value b. The value a is, for example, larger, for example at least twice as large, as the value b. In the illustrated position of the device 104, a force F1 acts at the first attachment point 1355, a force F2 acts at the second attachment point 1356, and a force F3 acts at the pivoting point 200, in the downward direction.

The door leaf weight force F3, at the connecting point to the door leaf 106, is located between the first supporting roller 1360 (force F1) and the second supporting roller 1363. The second supporting roller 1363 moves, in the region of the closed position of the door leaf 106, onto a connecting link 220 which is shaped as a wedge. According to this exemplary embodiment, the first supporting roller 1360 moves exclusively on the guide face 218 which is shaped as a running face. The second supporting roller 1363 basically also rolls on the guide face 218, but just before the closed position it moves onto the oblique face 1002 of the connecting link 220 and as a result controls the vertical movement of the door leaf 106.

The pair of rollers, composed of the supporting rollers 1360, 1363, is formed, on each door leaf 106, at least on the front edge and the rear edge of the door leaf 106.

Therefore, according to one exemplary embodiment, the device 104 has a further pivoting lever with further supporting rollers and a further connecting link. In order to integrate this arrangement in as space saving a fashion as possible with respect to the space requirement in the longitudinal direction (x direction) and in terms of the required rail length of the supporting rail 108, a certain overlap is possible. Such an overlap permits the second supporting roller on the front edge to move up to the connecting link 220 of the second supporting roller 1363 on the rear edge of the door leaf 106, as can be seen in FIG. 14.

Figure 14:
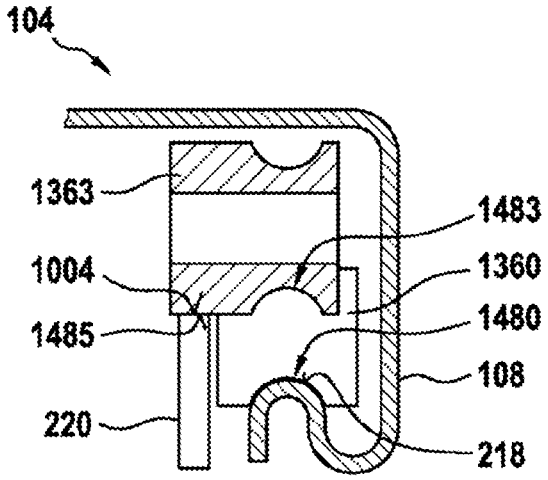
FIG. 14 shows a cross-sectional illustration of a device for sealing at least one door leaf according to an exemplary embodiment.

The advantage of the exemplary embodiments shown in FIGS. 13 and 14 is that the force F3, that is to say the weight force of the door leaf 106, is divided between the two supporting rollers 1360, 1363, also referred to as running rollers. As a result it is possible to avoid the loading on the first supporting roller 1360 being higher than the loading which is caused by the door leaf 106 and which corresponds to the force F3 acting at the pivoting point 200.

FIG. 14 shows a cross-sectional illustration of a device 104 for sealing at least one door leaf according to an exemplary embodiment. This can be a cross-sectional illustration of the device 104 shown in FIG. 13. In this context, the pivoting lever is not shown. The supporting rollers 1360, 1363 are illustrated, wherein the first supporting roller 1360 rests on the guide face 218 of the supporting rail 108, and the second supporting roller 1363 rests on the latching face 1004 of the connecting link 220.

The first supporting roller 1360 has a guide groove 1480 for guiding the first supporting roller 1360 along the guide face 218. The second supporting roller 1363 has a further guide groove 1483 for guiding the second supporting roller 1363 along the guide face 218, and a connecting link face 1485, arranged next to the guide groove 1483, for guiding the second supporting roller 1363 along the connecting link 220. According to this exemplary embodiment, the connecting link face 1485 is formed by a cylindrical section of the second supporting roller 1363.

According to this exemplary embodiment, the guide face 218 is formed by a U-shaped section of the supporting rail 108.

Figure 15:
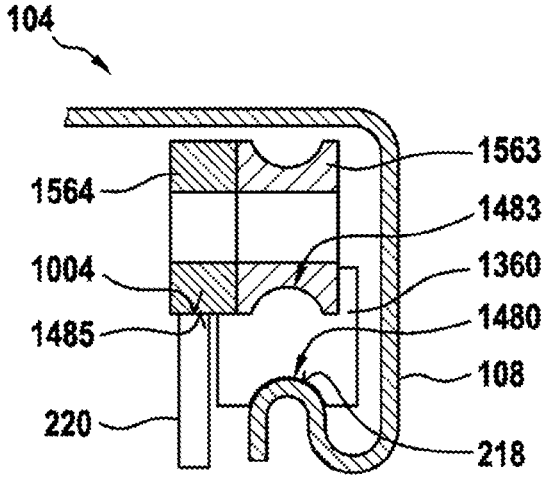
FIG. 15 shows a cross-sectional illustration of a device for sealing at least one door leaf according to an exemplary embodiment.

FIG. 15 shows a cross-sectional illustration of a device 104 for sealing at least one door leaf according to an exemplary embodiment. The device 104 corresponds to the exemplary embodiment which is described with reference to FIG. 14, with the difference that the second supporting roller unit is embodied in multiple parts, here for example two parts. According to this exemplary embodiment, the second supporting roller which is described with reference to FIG. 14, is divided in order to minimize slip and therefore also wear. Therefore, the second supporting roller unit comprises a second supporting roller 1563 and a further second supporting roller 1564. The second supporting roller 1563 has the further guide groove 1483 for guiding the second supporting roller unit along the guide face 218. The further second supporting roller 1564 has the connecting link face 1485 for guiding the second supporting roller unit along the connecting link 200. The two second supporting rollers 1563, 1564 have a common axis according to this exemplary embodiment.

If an exemplary embodiment comprises an "and/or" conjunction between a first feature and a second feature, this is to be understood that according to one embodiment the exemplary embodiment has both the first feature and the second feature, and according to a further embodiment the exemplary embodiment has either only the first feature or only the second feature.

LIST OF REFERENCE NUMBERS

100 rail vehicle
102 sliding door
104 device, guide system
106 door leaf
107 portal
108 supporting rail
110 guide path
112 sliding element, pivoting lever
200 pivoting point, rotational axis
202 supporting roller unit
204 supporting roller
206 guide arm
208 load arm
210 clip, door leaf carrier
212 attachment point
214 guide roller unit
216 guide roller
218 guide face
220 connecting link
600 sealing face
602 sealing element
604 gap
606 frame
608 tread bar profile
610 transverse profile
700 sealing element
702 sealing face
800 sealing face
802 sealing element
1000 projection
1002 oblique face
1004 latching face
1100 coupling element
1200 sealing method
1202 guiding operation
1204 raising or lowering operation
1350 pivoting lever
1351 first guide arm
1352 second guide arm
1355 first attachment point
1356 second attachment point
1360 first supporting roller
1361 first supporting roller unit
1363 second supporting roller
1364 second supporting roller unit
1480 guide groove
1483 guide groove
1485 connecting link face
1563 second supporting roller
1564 further second supporting roller

The invention claimed is:

1. A device for sealing at least one door leaf for a rail vehicle, the device comprising:

at least one sliding element which is designed to move the door leaf in a z direction of the rail vehicle in a region of a closed position to press a sealing element of the door leaf against a counter-sealing element of a portal of the rail vehicle, in which the sliding element is a passive component which is designed to carry out a movement of the door leaf in the z direction using a movement of the door leaf in the x direction, wherein the sliding element is configured to move the door leaf in an x direction of the rail vehicle, in order to move the door leaf between the closed position and an open position, wherein the sliding element has a pivoting lever which is rotatable about a pivoting point and has at least one guide arm, and wherein the pivoting lever has a first guide arm and a second guide arm, wherein the first guide arm has a first attachment point, on which a first supporting roller unit for guiding the first guide arm along a guide path is arranged, and the second guide arm has a second attachment point, on which a second supporting roller unit for guiding the second guide arm along the guide path is arranged, and wherein the pivoting point is coupled to the door leaf and is arranged between the first attachment point and the second attachment point.

2. The device of claim 1, in which the sliding element is designed to move the door leaf in response to a movement signal.

3. The device of claim 1, wherein the pivoting point is coupled to the first supporting roller unit which is linearly moved along a supporting rail which is linear at least in certain sections, wherein the first guide arm is supported on a guide path.

4. The device of claim 3, in which the guide path has a linear guide face and a connecting link, wherein the connecting link is bent with respect to the guide face.

5. The device of claim 4, in which the guide path is formed by the supporting rail, and the connecting link is connected in a positionally fixed fashion to the supporting rail.

6. The device of claim 4, in which the guide path is formed by the supporting rail, wherein the guide face and/or the connecting link is a cutout from the supporting rail.

7. The device of claim 4, in which a transition from the guide face to the connecting link is arranged less than 80 millimeters before the closed position of the door leaf.

8. The device of claim 4, in which the first supporting roller unit has a first supporting roller with a guide groove for guiding the first supporting roller unit along the linear guide face, and the second supporting roller unit has at least one second supporting roller with a guide groove for guiding the second supporting roller unit along the linear guide face and a connecting link face for guiding the second supporting roller unit along the connecting link.

9. The device of claim 3, in which the supporting rail has a convex supporting profile, and the first supporting roller unit has at least one supporting roller with a concave rolling profile, wherein the supporting profile is at least partially enclosed by the rolling profile.

10. A rail vehicle having the device of claim 1, wherein a supporting rail is oriented in the x direction, and the door leaf of a sliding door of the rail vehicle is connected to an attachment point of the pivoting lever, wherein the device is designed to raise or lower the door leaf in the region of the closed position.

11. A method for sealing door leaf for a rail vehicle with the device as recited in claim 1, the method comprising:

moving the door leaf in the z direction of the rail vehicle using the sliding element, in order to press the sealing element of the door leaf against the counter-sealing element of the portal of the rail vehicle in a region of the closed position of the door leaf, wherein the sliding element is configured to move the door leaf in the x direction of the rail vehicle, in order to move the door leaf between the closed position and the open position, wherein the sliding element has the pivoting lever which is rotatable about a pivoting point and has at least one guide arm, and wherein the pivoting lever has the first guide arm and the second guide arm, wherein the first guide arm has the first attachment point, on which the first supporting roller unit for guiding the first guide arm along the guide path is arranged, and the second guide arm has the second attachment point, on which the second supporting roller unit for guiding the second guide arm along the guide path is arranged, and wherein the pivoting point is coupled to the door leaf and is arranged between the first attachment point and the second attachment point.

* * * * *